US008013532B2

(12) United States Patent
Yamashita et al.

(10) Patent No.: US 8,013,532 B2
(45) Date of Patent: Sep. 6, 2011

(54) EXTRA-HIGH PRESSURE DISCHARGE LAMP

(75) Inventors: Takashi Yamashita, Hyogo (JP); Kazuhiro Goto, Hyogo (JP); Kazuhiro Yoshida, Hyogo (JP); Noriko Horikawa, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 319 days.

(21) Appl. No.: 12/292,913

(22) Filed: Dec. 1, 2008

(65) Prior Publication Data

US 2009/0140654 A1 Jun. 4, 2009

(30) Foreign Application Priority Data

Nov. 30, 2007 (JP) ..... 2007-310497

(51) Int. Cl.
*H01J 17/04* (2006.01)
*H01J 61/04* (2006.01)

(52) U.S. Cl. ..... 313/631; 313/633

(58) Field of Classification Search ..... 313/631, 313/568, 570, 633
See application file for complete search history.

(56) References Cited

U.S. PATENT DOCUMENTS

2005/0134180 A1* 6/2005 Ikeuchi ..... 313/633

FOREIGN PATENT DOCUMENTS

JP 59128753 A * 7/1984
JP 2007-287387 A 11/2007

OTHER PUBLICATIONS

Sengoku et al. JP 2007-287387; Jan. 11, 2007; Machine English Language Translation of the JP Publication which is in Japanese.*
Nakamura et al. JP 59-128753; Jul. 24, 1984; English Translation of the JP Publication.*

* cited by examiner

*Primary Examiner* — Nimeshkumar D Patel
*Assistant Examiner* — Glenn Zimmerman
(74) *Attorney, Agent, or Firm* — Rader, Fishman & Grauer PLLC

(57) ABSTRACT

An extra-high pressure discharge lamp, comprises an optical transparent light emitting section, sealing sections connected to the light emitting section, a pair of electrodes which face each other in the light emitting section, wherein one of the electrodes having a thick portion, a thin portion and an intermediate portion which is formed between the thick portion and the thin portion, wherein 0.15 mg/mm$^3$ of mercury is enclosed in the light emitting portion, and wherein the number of crystal grains which exist on a cross section perpendicular to an axis of the one of the electrodes is three.

15 Claims, 5 Drawing Sheets

FIG. 2B
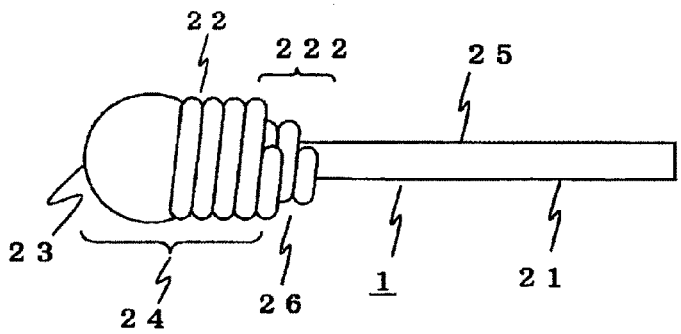
FIG. 2B
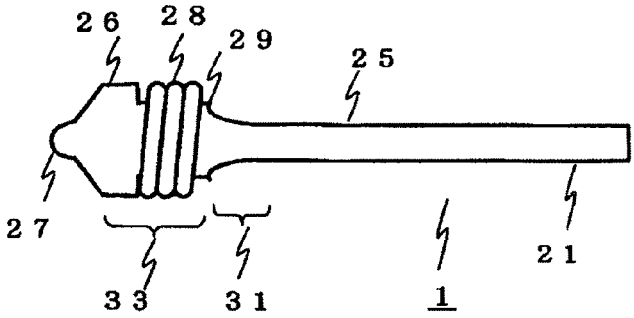
| The number of crystal grains | The number of samples | The number of occurrences of breakage |
|---|---|---|
| 1 | 40 | 38/40 |
| 2 | 15 | 1/15 |
| 3 | 10 | 0/10 |
| 4 | 8 | 0/8 |
| 5 | 7 | 0/7 |
| 6 or more | 20 | 0/20 |
FIG. 3

| Sample No. | Diameter of middle Portion d (mm) | Grain boundary distance L (mm) | L/d | Existence of breakage | Judgment |
|---|---|---|---|---|---|
| 1 | 2.5 | 2.76 | 1.1 | Found | × |
| 2 | 2.5 | 3.24 | 1.3 | Found | × |
| 3 | 2.5 | 4.25 | 1.7 | Found | × |
| 4 | 2.5 | 5.10 | 2.0 | Not found | ○ |
| 5 | 2.5 | 6.24 | 2.5 | Not found | ○ |
| 6 | 2.5 | 7.49 | 3.0 | Not found | ○ |
| 7 | 0.6 | 0.72 | 1.2 | Found | × |
| 8 | 0.6 | 0.83 | 1.4 | Found | × |
| 9 | 0.6 | 1.09 | 1.8 | Found | × |
| 10 | 0.6 | 1.21 | 2.0 | Not found | ○ |
| 11 | 0.6 | 1.55 | 2.6 | Not found | ○ |
| 12 | 0.6 | 1.97 | 3.3 | Not found | ○ |

FIG. 4

| Sample No. | Outer diameter of thick portion d1 (mm) | Outer diameter of thin Portion d2 (mm) | l Curvature radius of middle portion R (mm) | Coarsening | Judgment |
|---|---|---|---|---|---|
| 1 | 3.0 | 0.3 | 0.05 | Found | × |
| 2 | 3.0 | 0.3 | 0.10 | Not found | ○ |
| 3 | 3.0 | 0.3 | 0.20 | Not found | ○ |
| 4 | 3.0 | 0.7 | 0.05 | Found | × |
| 5 | 3.0 | 0.7 | 0.10 | Not found | ○ |
| 6 | 3.0 | 1.0 | 0.10 | Not found | ○ |
| 7 | 2.1 | 0.3 | 0.10 | Not found | ○ |
| 8 | 2.1 | 1.0 | 0.10 | Not found | ○ |
| 9 | 1.2 | 0.3 | 0.10 | Not found | ○ |
| 10 | 1.2 | 1.0 | 0.10 | Not found | ○ |

FIG. 5

EXTRA-HIGH PRESSURE DISCHARGE LAMP

CROSS-REFERENCES TO RELATED APPLICATION

This application claims priority from Japanese Patent Application Serial No. 2007-310497 filed Nov. 30, 2008, the contents of which are incorporated herein by reference in its entirety.

TECHNICAL FIELD

The invention relates to an extra-high pressure discharge lamp used for a projector apparatus, such as a DLP (digital light processor) using, for example, a liquid crystal display apparatus or a DMD (digital mirror device), and specifically relates to a crystal grain of an electrode arranged in a light emitting section (an arc tube) of an extra-high pressure discharge lamp, in which 0.15 mg/mm$^3$ of mercury is enclosed.

BACKGROUND

An extra-high pressure mercury lamp has been widely used as, for example, a light source of a projector apparatus for many years. In recent years, with progress of miniaturization of such a projector apparatus, a potable type projector is in widespread use. In even such a miniaturized projector apparatus, a sufficiently bright image is required for a light source, so as to be used daytime. Because of such a background, much more miniaturization and much higher output of a light source installed in such a projector apparatus are studied.

As one of measures of the miniaturization and accomplishment of high output, miniaturization of an electrode arranged in an extra-high pressure discharge lamp or a rod portion which holds an electrode is studied. Moreover, in order to achieve high output, the pressure therein is raised at time of lighting by raising high electric power applied to the electrode and increasing the quantity of mercury which is enclosed in a light emission section. However, in such an extra-high pressure discharge lamp with high electric power in which the electrode or the rod portion which holds the electrode is miniaturized, there is a problem that the electrode or the rod portion which holds the electrode often fractures or is broken. The "break or breakage", notably occurs in a portion of the electrode or the rod portion which holds the electrode, which is smallest in diameter. Moreover, the "break or breakage" occurs due to an external force applied to the extra-high pressure discharge lamp, such as vibration applied thereto at the time of manufacture, or during transportation thereof.

Japanese Laid Open Patent No. 2007-287387 teaches that in order to increase the mechanical strength of the portion (the smallest diameter portion) where the electrode or the rod portion which holds the electrode is smallest in diameter, the number of crystal grain boundaries of tungsten material which is a constituent of the electrode or the rod holding the electrode is increased to a predetermined number.

FIG. 7 shows an extra-high pressure discharge lamp of prior art. FIG. 7 is a schematic cross sectional view of the extra-high pressure discharge lamp, taken along a plane including the tube axis of the extra-high pressure discharge lamp. The extra-high pressure discharge lamp 100 is equipped with a bulb 110, in which the bulb 110 has an approximately spherical shaped light emission section 111 in which an interior space S is formed, and a pillar-shaped sealing portion 112 connected to both ends of the light emission section 111. While in the interior space S, a pair of electrodes 113 and 114 is arranged facing each other, 0.15 mg/mm$^3$ or more of mercury and halogen gas for performing a halogen cycles are enclosed as light-emitting material. Each of the electrodes 113 and 114 is partially buried in the sealing portion 112, and the electrode 113 is connected to one end of the metallic foil 115 for electric supply. The external lead 116 which projects outward from the sealing portion 112 is connected to the other end of the metallic foil 115. In the extra-high pressure discharge lamp of the prior art, for example, one of the electrodes, that is, the electrode 113 has the smallest diameter portion 117. The number of the grain boundaries which a straight line perpendicular to the electrode central axis crosses in a sectional view taken along a plane including the electrode center of the smallest diameter portion 117, is specified.

SUMMARY

Incidentally, demands of the miniaturization to the extra-high pressure discharge lamp and higher output thereof is further growing. The pressure of the extra-high pressure discharge lamp at time of lighting becomes still higher, and also lighting voltage of the extra-high pressure discharge lamp is improved so as to be larger. With such improvements, a problem of brake of an electrode occurs again. However, the breakage of the electrode occurs at the boundaries of the electrode and the axis portion, but not at the smallest diameter portion of the electrode. Furthermore, even though there is no problem at the time of manufacture of the extra-high pressure discharge lamp, or transportation thereof, there is a problem that breakage of the electrode occurs on the boundaries of the electrode and the axis portion after turning on the extra-high pressure discharge lamp for hundreds hours.

As a result of earnest research by the present inventors, it turns out that such a problem is caused by crystal grain coarsening of the electrode itself or at an axis portion of the electrode due to heat generated by lighting of the extra-high pressure discharge lamp. The tendency of this crystal grain coarsening becomes remarkable, as the purity of the tungsten material used for the electrode becomes higher. Furthermore, it turns out that the tendency of crystal grain coarsening becomes remarkable, as an input electric power at time of lighting became larger, and as the temperature of the electrode at time of lighting became higher. Moreover, it turns out that in an intermediate portion where the diameter of the electrode becomes small, that is, in a boundary between the thick diameter side of the electrode where large heat is generated, and the thin diameter side, which is an electrode rod, where the heat is transferred, a rapid temperature change occurs whereby crystal gain coarsening becomes remarkable along a diameter direction, thereby causing breakage of the electrode and/or the electrode axis portion. Furthermore, when the grain sizes of crystal grains of tungsten is in a certain range and there is a rapid temperature difference within a temperature range at which the grain grows, the grain boundaries of the crystal grain are formed on an isothermal face, and furthermore, movement and diffusion of holes and/or the defects due to impure gas contained in very small quantity of tungsten material is advanced according to a rapid temperature gradient, so that they stay on the grain boundary, whereby large voids (defects) tend to be formed, and it also turns out that the strength deterioration thereof is accelerated.

An object of the present invention is to suppress breakage of the intermediate portion which is the boundary of the electrode and the electrode axis portion, and to realize an extra-high pressure discharge lamp with a long lamp life span and high reliability.

The present extra-high pressure discharge lamp comprises an optical transparent light emitting section, sealing sections connected to the light emitting section, a pair of electrodes which face each other in the light emitting section, wherein 0.15 mg/mm$^3$ of mercury is enclosed in the light emitting portion, one of the electrodes having a thick portion, a thin portion and an intermediate (middle) portion which is formed between the thick portion and the thin portion, and the number of crystal grains which exist on a hypothetical line passing through the central axis of the electrode, on a cross section perpendicular to an axis of the one of the electrodes is three.

In the present extra-high pressure discharge lamp, a distance which connects grain boundaries and which crosses in the diameter direction of the electrode on a cross sectional view thereof taken along an electrode axial direction passing approximately a central axis of the intermediate portion, may be twice or more a diameter d of the intermediate portion. The "distance which connects grain boundaries" means a distance which is shortest when connecting both ends in a diameter direction of the electrode by tracing grain boundaries on a cross sectional view of the electrode taken along the central axis of the electrode.

Further, in the present extra-high pressure discharge lamp, the intermediate portion in the electrode axial direction of the electrode may be shaped so as to have a curve with 0.1 mm or more of curvature radius.

Moreover, in the present extra-high pressure discharge lamp, the electrode may be made of tungsten having 99.999% or more of purity.

Moreover, in the present extra-high pressure discharge lamp, halogen in a range of $10^{-6}$ μmol/mm$^3$ to $10^{-2}$ μmol/mm$^3$ may be enclosed in the light emission section.

In the present extra-high pressure discharge lamp, the light emitting section has an approximately closed space which is surrounded by the electrode and the light emission section connected to the light emission section in the sealing portion side, and in which tungsten material evaporated from the electrode stays.

In the present extra-high pressure discharge lamp, in the intermediate portion whose diameter becomes small from the thick diameter portion to the thin diameter portion of the electrode, since the number of the crystal grains which exist on a hypothetical line passing through the central axis of the electrode, on a cross section perpendicular to the axial direction of the electrode crosses is three or more, monotonous grain boundaries are formed in the entire electrode axis, whereby there is an advantage that it is possible to suppress deformation or breakage (drop in the thick diameter side) of the thick diameter portion of the electrode due to slippage of the grain boundaries.

Moreover, in the present extra-high pressure discharge lamp, when a distance which connects the grain boundaries and which cross in the diameter direction of the electrode on a cross sectional view thereof taken along the direction of the electrode axial passing approximately the central axis of the intermediate portion, is twice or more the diameter d of the intermediate portion of the electrode, even if the crystal grains of the intermediate portion grow, thereby coarsening, the shape of the crystal grains become complicated in the electrode axial direction, so that it is possible to suppress a problem of breakage and drop of the thick diameter portion in the intermediate portion of the electrode.

Furthermore, in the extra-high pressure discharge lamp according to the present invention, when the intermediate portion in the electrode axial direction of the electrode is shaped so as to have a curve with a curvature radius of 0.1 mm or more, since the amount of heat conducted from the electrode tip at time of lamp lighting changes rapidly, it is possible to suppress extreme grain coarsening of the crystal grain size in the intermediate portion. As a result, it is possible to effectively suppress the breakage of the electrode.

Moreover, in the extra-high pressure discharge lamp according to the present invention, when the purity of the tungsten which is a constituent of the electrode is 99.999% or more, even if the electrode tip reaches the melting temperature at time of lighting of the extra-high pressure discharge lamp, blacken substance resulting from the electrode does not accumulate on the arc tube by scattering of minute impurities, so that there is an advantage that a long-life span of the extra-high pressure discharge lamp can be realized. Moreover, when impurity contained in the tungsten which is a constituent of the electrode is low in amount, there is an advantage that it is possible to avoid the phenomenon in which the strength of the electrode decreases due to the holes and/or the defects in the crystal grain boundaries of the electrode.

Furthermore, in the extra-high pressure discharge lamp according to the present invention, when halogen in a range of $10^{-6}$ μmol/mm$^3$ to $10^{-2}$ μmol/mm$^3$ is enclosed in the light emission section, halogen cycles are performed by scattering from the electrode between the electrode and an inner surface of the light emission section, so as to suppress deposition of the electrode material on the light emission section, whereby there is an advantage that a long-life extra-high pressure discharge lamp can be realized.

Moreover, when the present extra-high pressure discharge lamp has an approximately closed space section which is surrounded by the electrode and the light emission section connected to the light emission section in the sealing portion side, and in which tungsten material evaporated from the electrode stays, high concentration tungsten steam which floats in the closed space enters and adheres to the micro gaps or cracks formed between the electrode surface and the crystal grain boundaries. Even if the crystal grain of the electrode becomes large and coarsens, there is an advantage that the gaps produced between the grain boundaries of the crystal grain are welded and the strength thereof is reinforced thereby.

BRIEF DESCRIPTION OF DRAWINGS

Other features and advantages of the present extra-high pressure discharge lamp will be apparent from the ensuing description, taken in conjunction with the accompanying drawings, in which:

FIG. 2 is an enlarged view of an electrode provided in an extra-high pressure discharge lamp according to the present invention;

FIG. 3 shows a relation between a breakage of an electrode provided in an extra-high pressure discharge lamp according to the present invention and the number of crystal grains;

FIG. 4 shows a relation between an electrode according to the present invention and a degree of entry of crystal grain;

FIG. 5 shows a relation between the shape of an electrode and crystal grain coarsening of crystal grain according to the present invention;

DETAILED DESCRIPTION

A description will now be given, referring to embodiments of the present extra-high pressure discharge lamp. While the claims are not limited to such embodiments, an appreciation of various aspects of the present flash lamp emitting device is best gained through a discussion of various examples thereof.

In an extra-high pressure discharge lamp according to the present invention, a pair of electrodes is arranged to face each other. The electrodes have a thick diameter portion, a thin diameter portion, and an intermediate portion, respectively. Two or more of crystal grains which exist on a cross section perpendicular to an electrode axis in the intermediate portion are provided. The crystal grain boundaries are complex in an electrode axial direction, and the intermediate portion has a curve with a radius of curvature of 0.1 mm or more. Moreover, an approximately closed space section is formed in a sealing portion side of a light emission section and is surrounded by the electrode and an inner wall of the light emission section. By such structure, the extra-high pressure discharge lamp prevents a breakage in early stages of lighting since two or more crystal grains in the intermediate portion of the electrode are formed therein. When lighting is performed for a long time and the crystal grains of the electrode become large and coarsen, since the high concentration tungsten steam which exists in the approximately closed space adheres to the grain boundaries or the surface thereof, the gaps produced between the crystal grain boundaries are restored.

Figure 1:
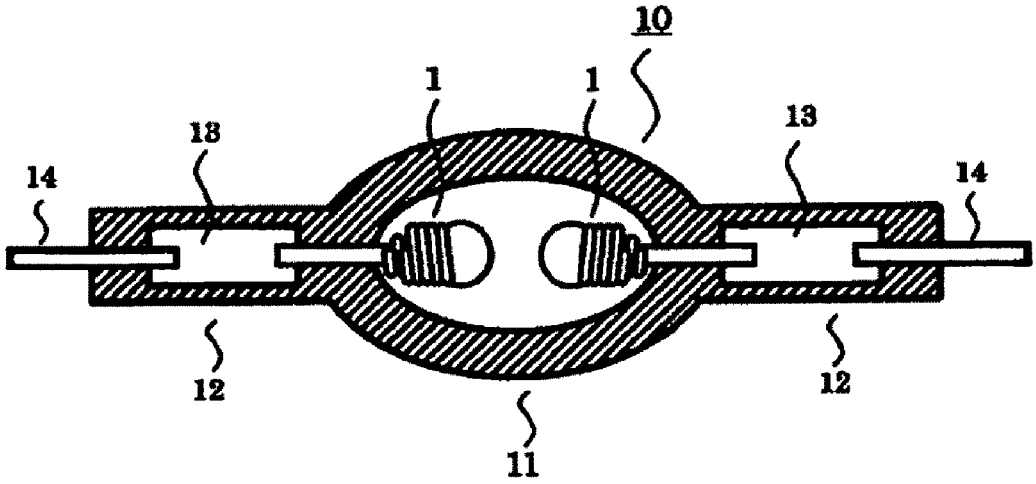
FIG. 1 is a schematic cross sectional view of an extra-high pressure discharge lamp according to the present invention.

FIG. 1 shows a schematic view of a first embodiment of an extra-high pressure discharge lamp 10 according to the present invention. For example, the extra-high pressure discharge lamp 10 is made up of a light emission section 11 made of optical permeability material, such as quartz glass, sealing portions 12 connected to the light emission section 11, and a pair of electrodes 1 facing each other. Moreover, one end of the electrode 1 is buried in the sealing portion 12, and is welded to a metallic foil 13. An external lead 14 is welded to the other end of the metallic foil 13, and projects from the sealing portion 12 to the outside.

Moreover, in the light emission section, 0.15 mg/mm$^3$ or more of mercury, and rare gas, specifically, Ar (for example 13 KPa) as gas for electric discharge, is enclosed. Moreover, a distance between the electrodes 1 facing each other (an electrode distance) is, for example, 2 mm when these electrodes are cooled down at time of non-lighting. Furthermore, halogen gas in a range of $10^{-6}$ μmol/mm$^3$ to $10^{-2}$ μmol/mm$^3$ is enclosed inside the light emission section.

FIGS. 2A and 2B are enlarged views of the electrode 1 provided in the extra-high pressure discharge lamp 10 shown in FIG. 1. FIG. 2A is the electrode for alternating current lighting in which a tip section 23 is formed by melting a coil 22 winded around the tip of a rod 21, together with the rod 21. In the electrode 1, the tip section 23 is formed by melting, so that a thick diameter portion 24 is made up of the tip section 23 and the coil 22. Moreover, part of the rod 21 forms a thin diameter portion 25 corresponding to the thick diameter portion 24. Moreover, an intermediate portion 26 whose diameter becomes small from the thick diameter portion 24 to the thin diameter portion 25 is formed by an end portion 222 of the coil 22 and part of the rod 21.

FIG. 2B shows the electrode for alternating current lighting which is formed by cutting work of the tip of the rod 21. A coil applied part 29 to which a projection section 27 formed in the tip section and a coil 28 are formed is provided in a tip section 26. Moreover, the tip section 26 forms the thick diameter portion 33 in an area between the projection section 27 and the back end of the coil applied part 29. Moreover, a rod 21 forms the thin diameter portion 25 corresponding to the thick diameter portion 33. Moreover, the intermediate portion 31 whose diameter becomes small from the thick diameter portion 33 to the thin diameter portion 25 is formed by cutting work. The intermediate portion 31 is shaped to have a curved surface whose diameter becomes small gently from the thick diameter portion 30 to the thin diameter portion 25, and the radius of curvature R of the curved surface is set to 0.1 mm or more.

Since the intermediate portion of such shape is provided, when the extra-high pressure discharge lamp 10 is lighted, using the electrodes 1, since in the process in which heat from the electrode tip, for example, the projection section 27 conducts, an extreme temperature difference is produced, a phenomenon in which the crystal grain size of the electrode 1 becomes large and coarsens suddenly is suppressed, so that it is possible to realize an electrode without breakage.

Moreover, as to the intermediate portion according to the present invention, the generation rate of the breakage was examined according to the number of the crystal grains which exist on the cross section perpendicular to the axial direction of the electrode. In this experiment, after a hundred of the extra-high pressure discharge lamps were lighted for a predetermined time, 300 hours, relation between the number of crystal grains in the intermediate portion of the electrode and the breakage of the electrode were checked. FIG. 3 shows the number of crystal grains, the number of samples of the electrode corresponding to that number, and the number of generation of breakage. In addition, all samples in which breakage occurred could not be lighted due to the breakage of the electrode in less than 300 hours. Thirty eight (38) out of the forty (40) lamps with the electrode in which the number of coarsening crystal grains was one (1), were broken. On the other hand, only one (1) of fifteen (15) lamps with the electrode in which the number of the crystal grains in the intermediate portion was two (2), was broken. Moreover, when the number of crystal grains was three (3) or more, a breakage did not occur at all. From the results, it is preferred that the number of crystal grains in the intermediate portion of the electrode be three (3) or more. In addition, samples with the crystal grain size which was controlled for the experiment were used, wherein the sizes of the crystal gains were adjusted by the amount of current at time of lighting of the extra-high pressure discharge lamp, and an increase pattern of the current. Specifically, the extra-high pressure discharge lamp was an alternating current lighting type, in which the electrode distance thereof is 1.1 mm to 1.3 mm, the internal volume of the light emission section is 130 mm$^3$, the rated voltage is 85 V, and the rated power 300 W.

Next, a degree of entry into the grain boundaries in the intermediate portion was evaluated. The intermediate (middle) portion was a portion whose diameter becomes smaller from the thick diameter portion to the thin diameter portion, and a diameter of an arbitrary position of the intermediate portion was set to "d". Here, the grain boundaries of the crystal grains which exist near the diameter d were connected, and a distance from an end of the diameter d of the intermediate portion to the other end thereof, was measured, so as to observe what times the diameter d it was. FIG. 4 is a table showing a result of the measurement. Two samples of the electrode were prepared. One of them had a thick diameter portion with a 3.0 mm diameter and the other one had a thick diameter portion with a 1.2 mm diameter. In the case the thick diameter portion had the 3.0 mm diameter, the diameter of the intermediate portion was measured at a portion where the diameter thereof was 2.5 mm (samples No. 1 to No. 6). Moreover, in the case the thick diameter portion had the 1.2 mm diameter, the diameter of the intermediate portion was measured at a portion where the diameter thereof was 0.6 mm (samples No. 7 to No. 12). These samples with various diameters of crystal grains were prepared by changing the amount of current at time of initial lighting, thereby changing a growth rate of crystal grain. In this experiment, the electrode samples No. 1-No. 3 and No. 7-No. 9 were broken. From the above result, it turns out that if the distance of the grain boundary was twice or more the diameter d of the intermediate portion, breakage was suppressed in all the samples. That is, if the distance of the grain boundary is twice or more the diameter d, even if the extra-high pressure discharge lamp is turned on for a long time and the crystal grain becomes large and coarsens, it is possible to suppress breakage of the intermediate portion.

FIG. 5 shows a result of experiment to check whether or not the crystal grain size of the intermediate portion became extremely large (coarsening). In this experiment, a cutting electrode formed by cutting work was used. Arc discharge was performed between the above electrode and an electrode plate in a side of an experimental device in a argon airflow. The electrode which was held for a predetermined time was used as samples, and the sample were ground in the electrode axial direction, so as to observe the crystal grain in a cross section taken along the electrode axial direction section, including the electrode axis. Here, it is called coarsening of crystal grain or crystal grain coarsening when there is one crystal grain formed over the entire outer diameter of each of the thick portion, the thin portion and the intermediate portion of the electrode.

Here, when the outer diameter (mm) of the thick portion of the electrode was represented as d1 and the outer diameter of the thin diameter portion thereof was represented as d2 (mm), the curvature radius R (mm) of the intermediate portion was changed, and the existence of crystal grain coarsening was checked. The samples No. 1 to No. 6 were prepared, assuming that the amount of heat conducted from the tip of the electrode was rapidly changed. The thick diameter portion d1 was set to 3.0 mm, and the thin diameter portion d2 was set in a range from 0.3 mm to 1.0 mm. In the sample No. 1, d1 was set to 3.0 mm, d2 was set to 0.3 mm and R was set to 0.05 mm. In this case, coarsening of crystal grain occurs in the intermediate portion, so that it was judged as no good as indicated by a symbol "x". Next, as to the samples No. 2 and No. 3, whose curvature radius R of the intermediate portion was 0.1 mm and 0.2 mm, respectively, a similar experiment was conducted. In this case, no coarsening of crystal grain occurred, so that it was judged as "usable" or "good" as indicated by a symbol (o). Next, in case of the sample No. 4, in which the outer diameter d2 of the thin diameter portion was set to 0.07 mm, and R was set to 0.05 mm, coarsening of crystal grain occurred so that it was judged as no good as indicated by the symbol "x". Moreover, as the sample No. 5, in which R was set to 0.1 mm, there was no coarsening of crystal grain, so that it was judged as "usable" as indicated by the symbol "o". In case of the sample No. 6, in which the thin diameter portion d2 was set to 0.1 mm and R was set to 0.1 mm, it was judged as usable as indicated by the symbol "o".

Next, in the samples No. 7 to No. 10, the outer diameter d1 of the thick diameter portion was set to as 2.1 mm and 1.2 mm, respectively, and the outer diameters d2 of the thin diameter section was set to 0.3 mm and 1.0 mm, respectively, and the curvature radius R was set to 0.1 mm. In these cases, there was no coarsening of crystal grain altogether, so that it was judged as usable as indicated by the symbol "o". These results show that coarsening of crystal grain can be suppressed, if the curvature radius R is set to 0.1 mm or more.

Moreover, when a high purity tungsten is used as a tungsten material used for the electrode, it is possible to suppress fall of the transmittance of the light emission section due to scattering of impurities. However, in general, it is known that the easier control of the diameter of crystal grain of tungsten, the more the amount of impurity therein is, and the higher the purity thereof is, the more a crystal grain grows. It is possible to manufacture material in which the diameter of crystal grain is comparatively controlled by adjusting the annealing temperature at time of tungsten manufacturing and/or a sectional area reduction rate at time of wiredrawing. According to the present invention, since the shape of the intermediate portion of the electrode and/or the number of crystal grain are specified. It is possible to realize an extra-high pressure discharge lamp with a long life span, using tungsten material of high purity of 99.999% or more.

Halogen gas in a range of $10^{-6}$ μmol/mm$^3$ to $10^{-2}$ μmol/mm$^3$ is enclosed inside the light emission section. Preferably, halogen in a range of $10^{-4}$ μmol/mm$^3$ to $10^{-2}$ μmol/mm$^3$ is enclosed therein. In this embodiment, bromine is enclosed as halogen.

A tungsten halide is formed from this halogen gas, when tungsten material which is evaporated due to heat from the electrode combines with the halogen gas. This tungsten halide floats in the light emission section, and returns to the electrode surface as tungsten again. Thereby, an optical transmittance of an inner wall of the light emission section is not reduced by adhesion thereof etc., so that the extra-high pressure discharge lamp with a long life span can be realized.

Figure 6:
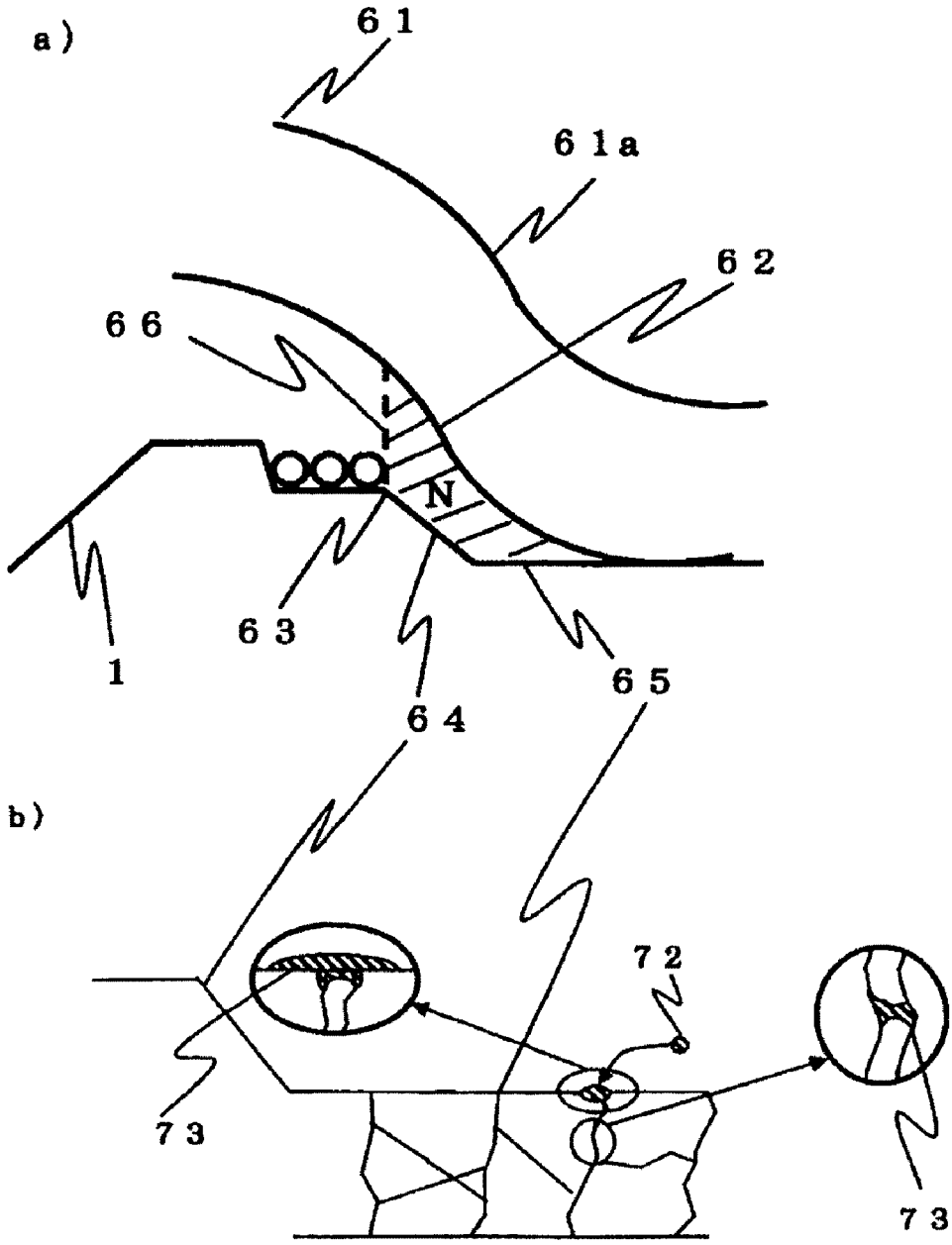
FIG. 6 is a schematic diagram explaining an approximately closed space formed in a light emission section according to the present invention.
Figure 7:
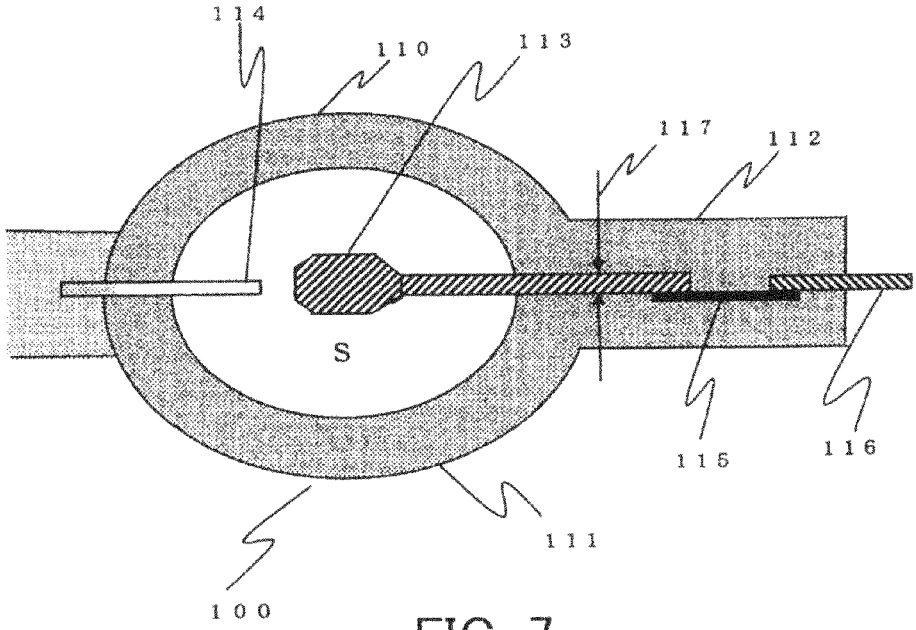
FIG. 7 is a schematic cross sectional view of a conventional extra-high pressure discharge lamp.

Next, FIG. 6 show a case where an approximately closed space N for making tungsten material stay in the light emission section 61 is provided. FIG. 6(*a*) is a schematic and enlarged cross sectional view of one of electrodes 1 of the extra-high pressure discharge lamp 10. The approximately closed space N is formed by an inner wall 62 of the light emission section 61 and an electrode surface extending from an end 63 of a thick diameter portion of the electrode 1 to a thin diameter portion 65 thereof via an intermediate portion 64 thereof, in a sealing portion 61*a* side of the light emission section 61. Here, the approximately closed space N, means a space which is seen as if a space is defined, since the approximately closed space N gradually becomes small in space from the opening 66 to the end thereof, although a portion (an opening 66) from which the tungsten material evaporated from the electrode 1 enters, is opened to a space.

The closed space N forms a space where a gas convection therein at time of lighting of the extra-high pressure discharge lamp 10 is greatly different from that generated in the light emission section 61 in terms of speed thereof. Moreover, in part of the closed space N, the temperature thereof is comparatively low, so that the density of tungsten steam therein becomes high during time of lighting. Since the tungsten steam adheres and deposits on the intermediate portion 64 of the electrode 1, or the surface of the thin diameter portion 65, even if the diameter of crystal grain of the electrode 1 becomes large and coarsens, slip of the grain boundary is suppressed by the tungsten adhered and accumulated on the surface between the grain boundaries. Furthermore, the tungsten which adheres and deposits on the surface of the electrode 1 enters in gaps which are formed between the grain boundaries of the crystal grain, so that there is an advantage that these gaps between the grain boundaries are repaired. FIG. 6B is a schematic view showing a case where the tungsten adheres and deposits thereon and slip of grain boundaries is suppressed whereby the gaps between the grain boundaries are restored. The tungsten 71 which is evaporated, floats on the surface of thin diameter portion 65 of the electrode 1, and adheres and deposits thereon. At time of lighting of the extra-high pressure discharge lamp 10, this tungsten 72 which adheres and deposits thereon, enters between grain boundaries 73 of the grain boundaries formed in the surface of the electrode 1 etc., and functions as restoration material, thereby suppressing slip of the grain boundary etc., so that the breakage in the intermediate portion 64 of the electrode 1 can be suppressed. Specifically, when the extra-high pressure discharge lamp 10 is lighted for a long time, the function as restoration material of the tungsten 72 which adheres and deposits thereon becomes remarkable.

The preceding description has been presented only to illustrate and describe exemplary embodiments of the present fused joint structure in a lamp tube, and the present forming method thereof according to the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An extra-high pressure discharge lamp, comprising:
an optical transparent light emitting section;
sealing sections connected to the light emitting section;
a pair of electrodes which face each other in the light emitting section,
wherein one of the electrodes having a thick portion, a thin portion and an intermediate portion which is formed between the thick portion and the thin portion,
wherein 0.15 mg/mm$^3$ of mercury is enclosed in the light emitting portion,
wherein the number of crystal grains which exist on a cross section perpendicular to an axis of the one of the electrodes is three,
wherein a distance which connects grain boundaries and which crosses in the diameter direction of the electrode on a cross section thereof taken along an electrode axial direction passing approximately a central axis of the intermediate portion, is twice or more a diameter d of the intermediate portion.

2. The extra-high pressure discharge lamp according to claim 1, wherein the electrode is made of tungsten having 99.999% or more of purity.

3. The extra-high pressure discharge lamp according to claim 2, wherein halogen in a range of $10^{-6}$ μmol/mm$^3$ to $10^{-2}$ μmol/mm$^3$ is enclosed in the light emission section.

4. An extra-high pressure discharge lamp comprising:
an intermediate portion of an electrode between thick and thin portions of the electrode, diameters of the intermediate portion along an axial direction of the electrode decreasing from said thick portion to said thin portion,
wherein each cross section of the intermediate portion along said axial direction has at least three crystal grains, said each cross section being perpendicular to said axial direction.

5. The extra-high pressure discharge lamp according to claim 4, further comprising:
sealing portions connected to a light emission section, said light emission section being of an optical permeability material.

6. The extra-high pressure discharge lamp according to claim 5, wherein said thin portion extends from one of the sealing portions into said light emission section, said intermediate and thick portions being within said light emission section.

7. The extra-high pressure discharge lamp according to claim 5, wherein a metallic foil with said one of the sealing portions connects said thin portion to an external lead, said external lead projecting from said one of the sealing portions.

8. The extra-high pressure discharge lamp according to claim 5, wherein another electrode extends from another of the sealing portions into said light emission section, a space within said light emission section separating said electrode from said another electrode.

9. The extra-high pressure discharge lamp according to claim 8, wherein another metallic foil with said another of the sealing portions connects said another electrode to another external lead, said another external lead projecting from said another of the sealing portions.

10. The extra-high pressure discharge lamp according to claim 5, wherein 0.15 mg/mm$^3$ of mercury is enclosed in said light emission section.

11. The extra-high pressure discharge lamp according to claim 5, wherein halogen in a range of $10^{-6}$ μmol/mm$^3$ to $10^{-2}$ μmol/mm$^3$ is enclosed in said light emission section.

12. The extra-high pressure discharge lamp according to claim 4, wherein a surface of said intermediate portion along the axial direction has a curvature radius, said curvature radius being 0.1 mm or more.

13. The extra-high pressure discharge lamp according to claim 4, wherein said electrode is made of tungsten, said tungsten having a purity of 99.999% or more.

14. The extra-high pressure discharge lamp according to claim 4, wherein a coil surrounds said thick portion.

15. The extra-high pressure discharge lamp according to claim 4, wherein any diameter along said thick portion is greater than any diameter along said thin portion.

* * * * *